United States Patent [19]

Ono et al.

[11] Patent Number: 5,045,682

[45] Date of Patent: Sep. 3, 1991

[54] X-RAY IMAGE INTENSIFIER HAVING COLUMNAR CRYSTALS HAVING A CROSS SECTION DECREASE AS IT GOES TOWARDS THE EDGE

[75] Inventors: Katsuhiro Ono, Kawasaki; Hidero Anno, Ootawara, both of Japan

[73] Assignee: Kabushiki Kaisha Toshiba, Kawasaki, Japan

[21] Appl. No.: 526,907

[22] Filed: May 22, 1990

[30] Foreign Application Priority Data

May 23, 1989 [JP] Japan ..... 1-129842

[51] Int. Cl.[5] ..... H01J 31/50; H01J 40/14

[52] U.S. Cl. ..... 250/213 VT; 313/526; 313/525

[58] Field of Search ..... 230/213 VT; 313/525, 313/526, 527, 528, 529, 530

[56] References Cited

U.S. PATENT DOCUMENTS 4,740,683 4/1988 Noji et al. ..... 250/213 VT
4,935,617 6/1990 Anno et al. ..... 250/213 VT

FOREIGN PATENT DOCUMENTS 1315930 12/1989 Japan .

*Primary Examiner*—David C. Nelms
*Assistant Examiner*—T. Davenport
*Attorney, Agent, or Firm*—Cushman, Darby & Cushman

[57] ABSTRACT

An X-ray image intensifier includes an input screen for converting incident X-ray into photoelectrons. The input screen has a substrate, a phosphor layer having a layer number of columnar crystals of a phosphor formed with gaps therebetween on the substrate, and a photoelectric layer directly or indirectly provided on the phosphor layer. The columnar crystals at a peripheral edge portion of the input screen are thinner than the columnar crystals at a central portion of the input screen.

8 Claims, 6 Drawing Sheets

X-RAY IMAGE INTENSIFIER HAVING COLUMNAR CRYSTALS HAVING A CROSS SECTION DECREASE AS IT GOES TOWARDS THE EDGE

BACKGROUND OF THE INVENTION

1. Field of the Invention

The present invention relates to an X-ray image intensifier, and more particularly, to an X-ray image intensifier having an improved input screen.

2. Description of the Related Art

In general, an observation system comprises an X-ray tube and an X-ray image intensifier disposed in front of the X-ray tube, and an object to be imaged is located between these tubes. X-rays emitted from the X-ray tube are transmitted through the object to form a modulated X-ray image. The X-ray image is projected on the X-ray image intensifier. A visible output image obtained at the X-ray image intensifier is imaged by means of, e.g., an imaging camera, and reproduced by means of a monitor television.

The X-ray image intensifier has an input screen and an output screen opposed to each other. In operation, the modulated X-ray image incident upon the image intensifier is converted into a photoelectron image by the input screen, and is then, accelerated and focused toward the output screen. Thereupon, a visible output image with an enhanced luminance can be obtained on the output screen. The output image thus obtained is observed through the imaging camera or the like.

Conventionally, the input screen of the X-ray image intensifier is formed of a phosphor layer including a plurality of columnar crystals of CsI:Na (sodium-activated cesium iodide) phosphor formed on a concave surface of a spherical aluminum substrate, an intermediate layer formed of an aluminum oxide layer and an indium oxide layer, and a photoemissive layer, arranged in succession.

In order to minimize exposure of the object to X-rays, in the observation system using the X-ray image intensifier constructed in this manner, the X-rays transmitted through the object must be applied to the phosphor layer without a loss so that the amount of X-rays absorbed by the phosphor layer is increased. In order to increase the amount of X-ray absorption by the phosphor layer, the columnar crystals of the phosphor layer should preferably be lengthened. If the columnar crystals are lengthened, however, the amount of fluorescence propagated from the side face of one crystal to another increases, and the resolution of the image intensifier lowers. Thus, the columnar crystals cannot be made very long, and are limited to a length of 400 $\mu$m or thereabout.

Since the phosphor layer is formed on the concave surface of the spherical substrate, the columnar crystals extend from the substrate toward the center of curvature of the spherical surface. At the peripheral edge portion of the phosphor layer, therefore, each of the X-rays emitted from the X-ray tube diagonally crosses the crystals. Thus, the resolution at the peripheral edge portion of the input screen is lower than that at the central portion.

SUMMARY OF THE INVENTION

The present invention has been contrived in consideration of these circumstances, and its object is to provide an X-ray image intensifier capable of lessening reduction of resolution and brightness at the peripheral edge portion of an input screen.

In order to achieve the above object, according to an X-ray image intensifier of the present invention, columnar crystals at the peripheral edge portion of a phosphor layer of an input screen are formed thinner than one at the central portion of the phosphor layer.

According to the arrangement described above, the phosphor layer of the input screen includes the columnar phosphor crystals of a sufficient length, and the crystals at the peripheral edge portion of the input screen are thinner than the ones at the central portion. Thus, X-rays cross more columnar crystals at the peripheral edge portion than at the central portion. However, fluorescence produced at the peripheral edge portion must cross more columnar crystals than fluorescence produced at the central portion, in order to propagate for the same transverse distance as the latter. As the fluorescence propagates from the side face of one crystal to another, the fluorescence partially reflects and attenuates its intensity at the crystal boundaries. Therefore, the distance of propagation of the fluorescence at the peripheral edge portion in the transverse direction or the diametrical direction of the input screen is shorter than that of the fluorescence at the central portion.

Thus, even if the incident X-rays at the peripheral edge portion of the input screen cross a large number of crystals to make them fluoresce, the resolution at the peripheral edge portion can be prevented from lowering, since the transverse propagation distance of the fluorescence produced in the crystals is short.

Further, according to the present invention, the distal end portions of the columnar crystals, which constitute a phosphor layer surface, are arranged closer to one another than the other portions of the crystals. Namely, the gaps between the distal end portions of the crystals are narrower than the gaps between the other portions.

Since the distal end portions of the columnar crystals are formed closer than the other portions, moreover, the surface of the phosphor layer is substantially continuous. Accordingly, alkaline metals which constitute a photoemissive layer on the phosphor layer can be prevented from diffusing and disappearing into the phosphor layer. Thus, the photoemissive layer is stable, and reduction of its sensitivity can be lessened.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 10 show a subject observation system with an X-ray image intensifier according to an embodiment of the present invention, in which:

FIG. 1 is a side view, partially in section, schematically showing an outline of the system;

FIG. 2 is a sectional view of an input screen;

FIG. 3 is an enlarged sectional view showing the central portion of the input screen;

FIG. 4 is an enlarged sectional view showing the peripheral edge portion of the input screen;

FIG. 5 is a graph showing relationships between average pitches and average diameters of columnar crystals at different portions of a phosphor layer;

FIG. 6 is a graph showing the way the gaps between the columnar crystals vary;

FIG. 7 is a sectional view showing the way of propagation of fluorescence at the central portion of the input screen;

FIG. 8 is a diagram showing line spread functions at the central portion of the input screen;

FIG. 9 is a sectional view showing the way of propagation of fluorescence at the peripheral edge portion of the input screen; and FIG. 10 is a diagram showing line spread functions at the peripheral edge portion of the input screen.

DETAILED DESCRIPTION OF THE PREFERRED EMBODIMENTS

An embodiment of the present invention will now be described in detail with reference to the accompanying drawings.

Figure 1:
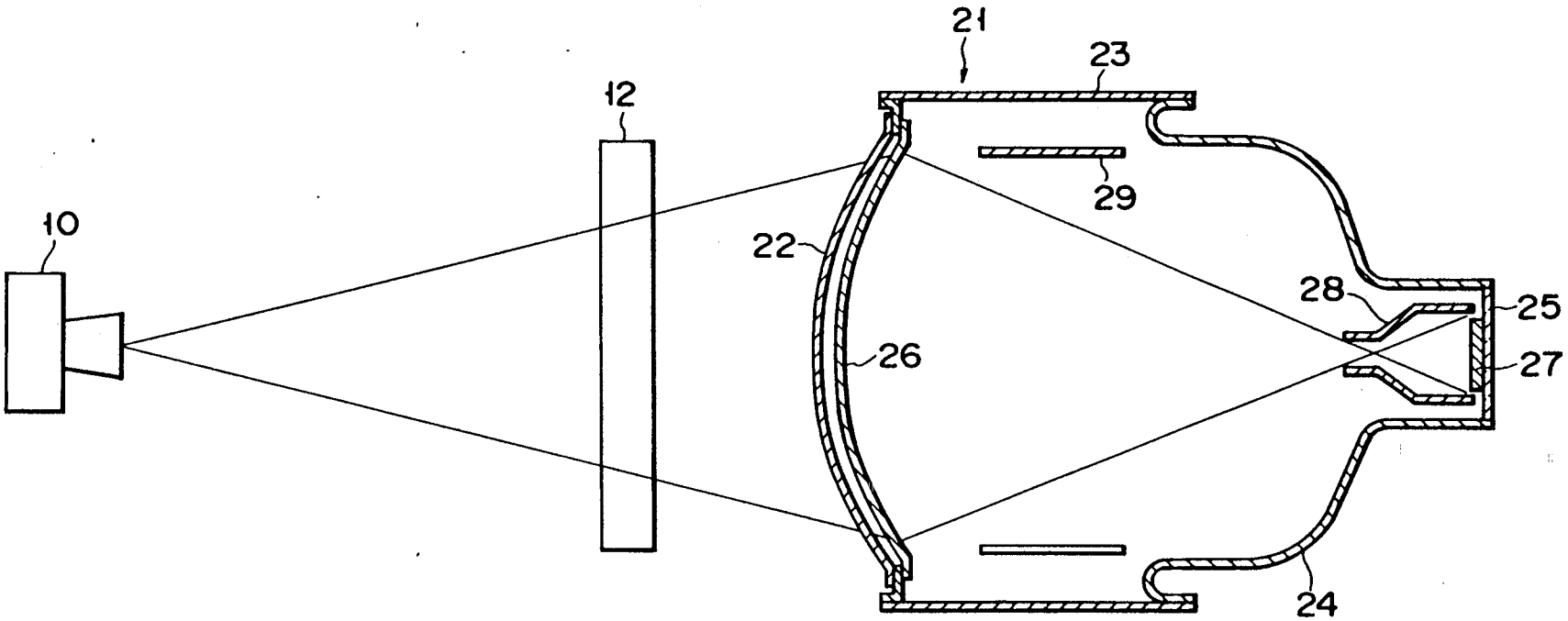

FIG. 1 shows a subject observation system with an X-ray image intensifier according to an embodiment of the present invention.

The X-ray image intensifier comprises a vacuum envelope 21. The envelope 21 includes a substantially cylindrical metallic barrel portion 23, a spherical metallic input window 22 attached to one end of the barrel portion in a hermetically sealed manner and preamble to X-rays, a funnel-shaped seal member 24 of Kovar one end of which is airtightly attached to the other end of the barrel portion, and a glass output window 25 hermetically attached to the other end of the seal member.

An input screen 26 having a phosphor layer and a photoemissive layer (mentioned later) is provided on the concave surface side of the input window 22. Facing the input screen 26, an output screen 27 having a phosphor layer is formed on the inside of the output window 25. A focusing electrode 29 is disposed inside the barrel portion 23, and an anode 28 is opposed to the output screen 27 inside the seal member 24.

The observation system comprises an X-ray tube 10 disposed in front of the X-ray image intensifier, and an object 12 to be imaged is located between the X-ray tube 10 and the X-ray image intensifier. X-rays emitted from the X-ray tube 10 are transmitted through the object 12 to form a modulated X-ray image. The X-ray image is transmitted through the input window 22 of the X-ray image intensifier to be incident upon the input screen 26. The incident X-ray image causes the phosphor layer to fluoresce on the input screen 26. The photoemissive layer delivers photoelectrons excited by the fluorescence, so that the X-ray image is converted into a photoelectric image. After the photoelectric image is accelerated and focused by the anode 28 and focusing electrode 29, respectively, it reaches the output screen 27, whereupon it is converted into a high-brightness visible image by means of the output phosphor layer.

The input screen 26 of the X-ray image intensifier will be described in detail.

Figure 2:
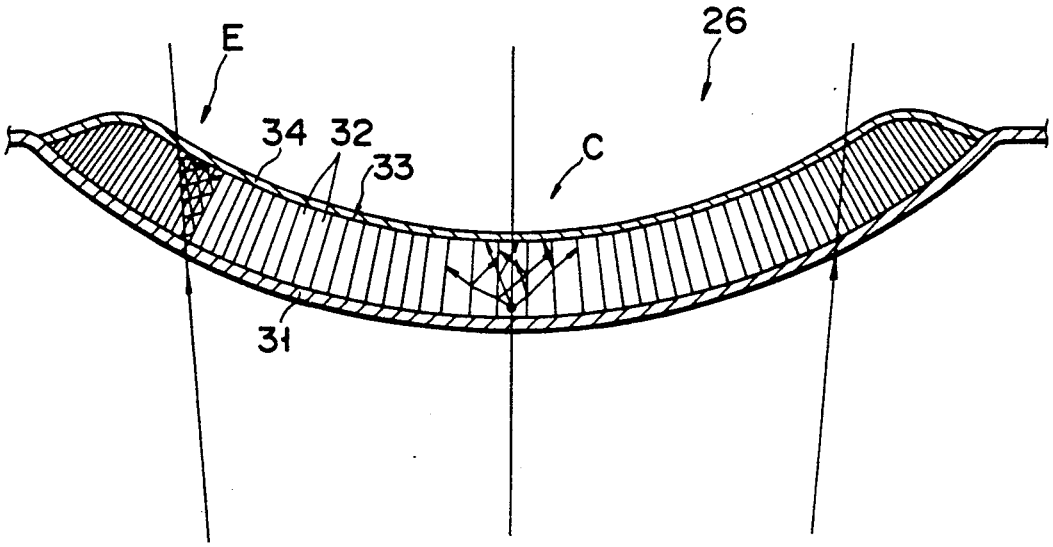

As shown in FIG. 2, the input screen 26 includes a substrate 31 formed of, e.g., a thin aluminum plate, a phosphor layer 33 formed on the inner surface or concave surface of the substrate, and a photoemissive layer 34 formed of, e.g., a $K_2CsSb$ or $K_2NaSb$ and coated on the surface of the phosphor layer. The phosphor layer 33 includes a plurality of columnar crystals 32 of, e.g., CsI:Na (sodium-activated cesium iodide) phosphor formed on the inner surface of the substrate 31. Individual crystals 32 constituting phosphor layer 33 are gradually reduced in thickness with distance from the central portion (indicated by arrow C) of the input screen 26 toward the peripheral edge portion (indicated by arrow E). The crystals 32 at the peripheral edge portion E are, for example, 10% to 20% thinner than the ones at the central portion C.

Figure 3:
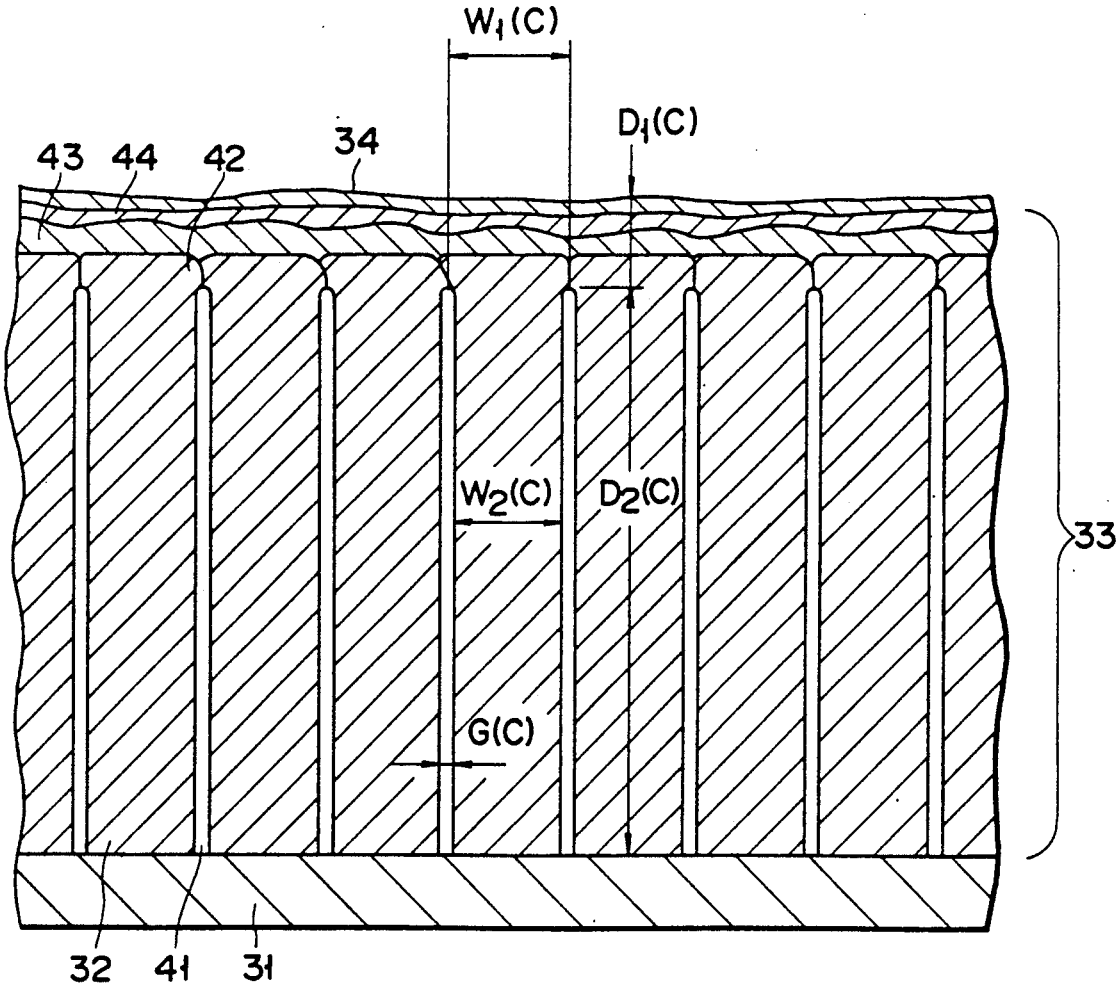
Figure 4:
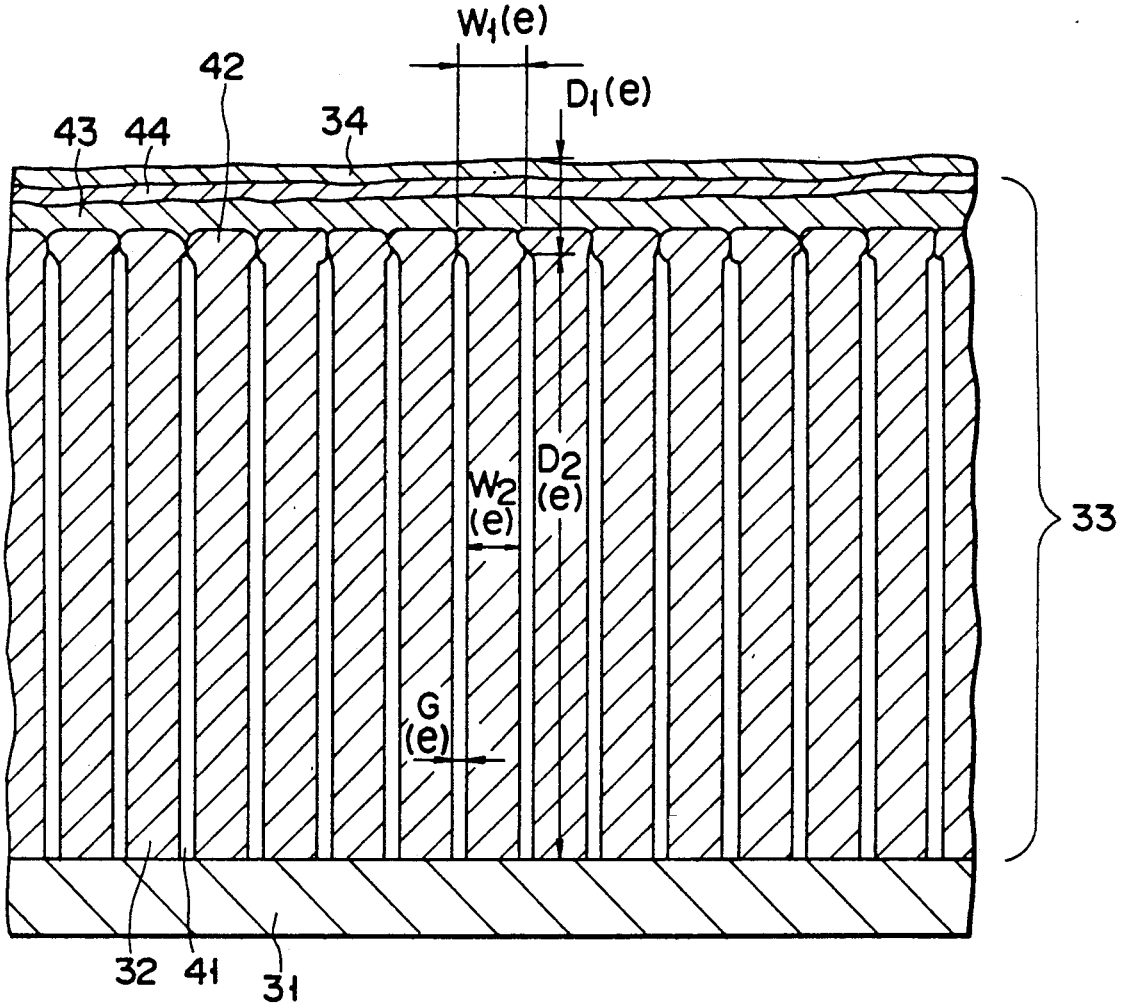

FIGS. 3 and 4 are enlarged views showing the central portion and the peripheral edge portion, respectively, of the input screen 26. As seen from these drawings, the columnar crystals 32 extend from the spherical substrate 31 toward the center of curvature of the substrate, and gaps 41 of width G necessary for optical separation between the crystals are defined between adjacent crystals 32. An extending end portion or top portion 42 of each crystal 32, situated on the opposite side thereof to the substrate 31, is shaped so that its cross section is larger than that of the other portion, and the respective top portions 42 of the crystals are continuously in intimate contact with one another. Thus, the top portions 42 of the crystals 42 are arranged more tightly than the other portions, and their top surfaces constitute a substantially continuous phosphor layer surface. Formed on this surface is an outer layer 43 of CsI:Na phosphor or CsI phosphor which, in conjunction with the crystals 32, constitute the phosphor layer 33. Further, a conductive protective film 44 of indium oxide or the like is formed on the outer layer 43. The photoemissive layer 34 is formed on the protective film 44.

The following methods are used to increase the cross section of the top portions 42 of a large number of columnar crystals 32, thereby forming a continuous surface. One of these methods is a tumbling method in which a large number of small metal spheres of stainless steel or the like are placed on a large number of columnar crystals formed by vacuum evaporation on the substrate, and these small spheres are horizontally oscillated so that the top portions 42 of the crystals are squeezed flat to a larger diameter by means of the spheres. Another method is a grinding method in which the top portions 42 of the crystals 32 are horizontally rubbed by means of a grinding member while rotating the substrate 31 with the crystals thereon, thereby filling up the gaps between the top portions. Preferably, in either method, a force applied to each crystal 32 in the longitudinal direction thereof is limited to a small value during the machining process lest the optical properties of phosphor layer 33 be spoiled. It is to be desired, moreover, that the depth of that portion of the input screen 26 which has no gaps 41, that is, depth D1 from the surface of the photoemissive layer 34 to the region corresponding to the enlarged top portions 42, should be 10 μm or less.

As described above, the top portions 42 of the columnar crystals 32 are horizontally extended and flattened by receiving a horizontal external force. Accordingly, pinholes or gaps between the adjacent top portions are extremely reduced, substantially to zero.

Thus, by forming the continuous outer layer 43 of a phosphor on the columnar crystals 32 by high-vacuum evaporation, the continuity and closeness of the surface of the outer layer 43 are improved, and the pinholes are further reduced. Accordingly, the continuity and closeness of the protective film 44 on the outer layer 43 are improved, and the photoemissive layer 34 on the film 44 is securely physically isolated from the outer layer 43 and columnar crystals 32 by means of the continuous, close protective film. Thus, potassium, cesium, and sodium, which constitute the photoemissive layer 34, can be prevented from diffusing and disappearing into the phosphor layer 33, so that the sensitivity of the photoemissive layer 34 can be kept at a high value without being lowered.

In the input screen 26 constructed in this manner, moreover, the resolution obtained with use of the phosphor layer 33 may be improved by thinning or omitting the outer layer 42, or by using a low-resistance material for the photoemissive layer 34 so that the protective layer 44 can be omitted. In the cases of these arrangements, however, the photoemissive layer 34 suffers some pinholes. The number of pinholes, which is correlative to the number of gaps 41 or columnar crystals 32 per unit area, tends to increase at the peripheral edge portion E of the input screen 26. In the aforesaid cases, therefore, it is advisable to increase the deformation or enlargement in diameter of the top portions 42 of the columnar crystals 32 at the peripheral edge portion of the input screen 26.

The dimensions of various parts of the input screen 26 shown in FIGS. 3 and 4 have the following relationships.

$$W2(c) > W2(e),$$

$$D1(c) \leqq D1(e),$$

$$G(c) = G(e),$$

$$W2(e)/W1(e) < W2(c)/W1(c),$$

where W1 is the average pitch of the columnar crystals 32; W2, average outside diameter of the crystals 32; D1, depth from the surface of the photoemissive layer 34 to the deformed portion of each crystal 32, that is, average depth of the portion without the gaps 41; D2, average depth of those portions of the crystals 32 which have the gaps 42; G, average width of the gaps 41; and c and e, central portion and peripheral edge portion, respectively, of the input screen 26.

Figure 5:
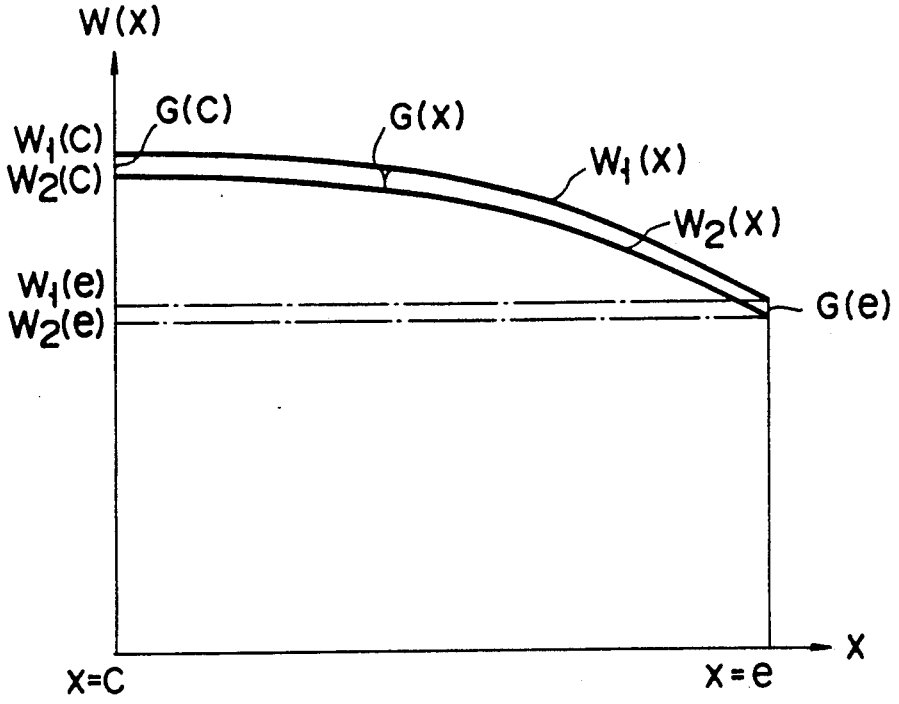
Figure 6:
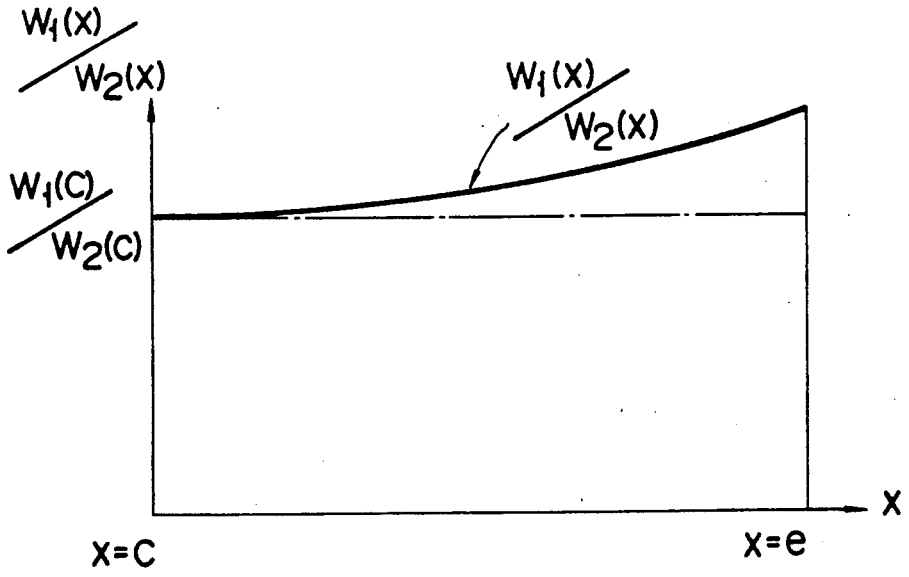

FIGS. 5 and 6 show the way the aforementioned dimensions vary in the region between the central portion C of the input screen 26 to the peripheral edge portion E.

If the top portions 42 of the columnar crystals 32 are not enlarged and flattened, as in the conventional case, at such a region as the peripheral edge portion E of the input screen 26 where the crystals 32 have relatively short diameters, the number of gaps 41 between the top portions 42 per unit area is large. Accordingly, the number of pinholes in the protective film 44 on the crystals 32 is also large. Thus, the alkaline metals, such as potassium, cesium, and sodium, which constitute the photoemissive layer 34 on the protector film 44, may diffuse and disappear into the phosphor layer 33, thereby lowering the sensitivity of the photoemissive layer 34.

In the present embodiment, however, the top surfaces of the top portions 42 of the columnar crystals 32 are extended and flattened by machining so that they, in intimate contact with one another, constitute a continuous surface. Thus, the alkaline metals, such as potassium, cesium, and sodium, which constitute the photoemissive layer 34, can be prevented from diffusing and disappearing into the phosphor layer 33, so that the sensitivity of the photoemissive layer 34 cannot be lowered. In consequence, a high-sensitive, stable photoemissive layer 34 can be formed.

The following is a description of the resolution of the input screen 26.

Figure 7:
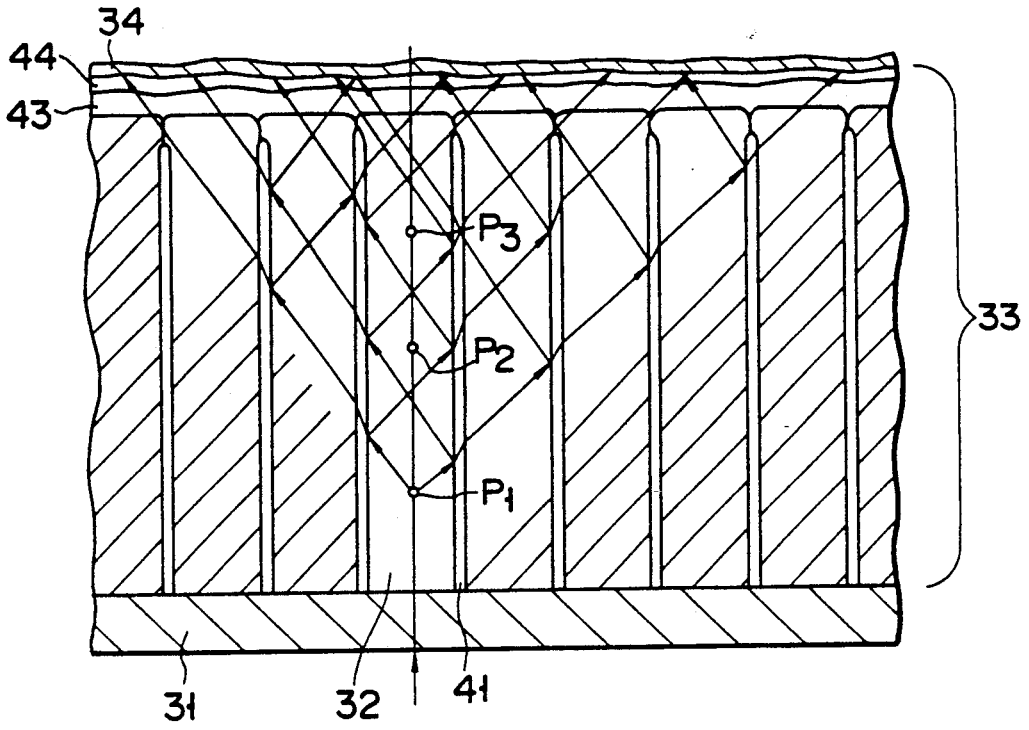

As shown in FIGS. 2 and 7, X-rays incident upon the central portion C of the input screen 26 enter the columnar phosphor crystals 32 in a direction substantially parallel to the crystals, and some of them are absorbed at a shallow position P1 with respect to the incidence side, thus producing fluorescence.

The fluorescence produced at the position P1 reaches the photoemissive layer 34 while repeating reflection and transmission. A line spread function indicative of the spread of the fluorescence is represented by curve LSF(C,1) in FIG. 8.

Figure 8:
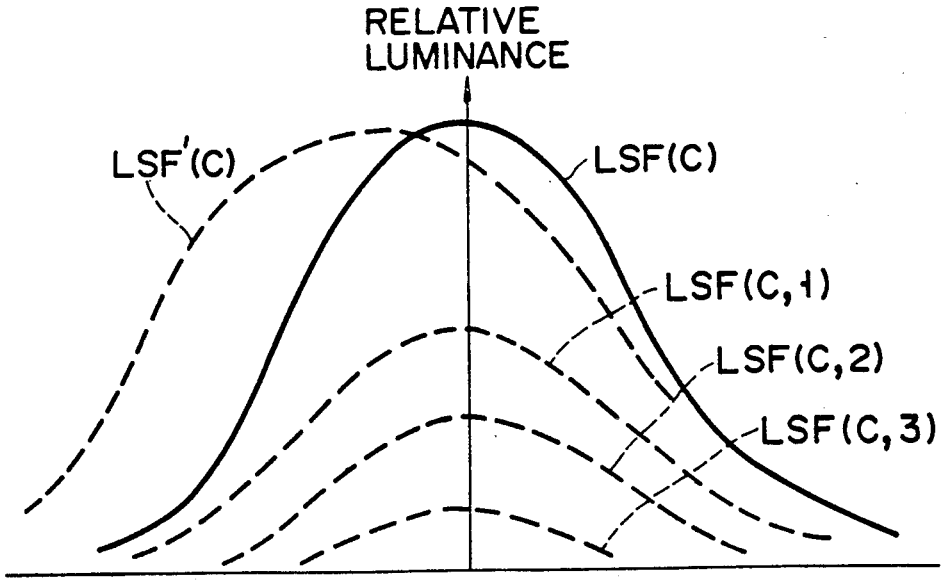

Likewise, the line spread functions of fluorescences produced at deeper positions P2 and P3 are represented by curves LSF(C,2) and LSF(c,3), respectively, in FIG. 8.

These line spread functions are functions of depth, depending on the decrease of radiation due to the absorption of the X-rays or attenuation of light. Synthetic line spread function (c) can be obtained by integrating the above LSFs with respect to the direction of the depth.

If the X-rays incident upon the central portion C of the input screen 26, like the X-rays incident upon the peripheral edge portion E, diagonally cross the columnar crystals 32, then it comes to the same result as when the radiating positions P1, P2 and P3 are moved sideways. In this case, the synthetic line spread function is equivalent to the synthetic line spread function LSF(c), synthesized from LSF(c1), LSF(c,2), and LSF(c,3) shifted in the horizontal direction of FIG. 8. The width of the synthetic line spread function is greater than that of LSF(c), that is, the resolution is low.

Conventionally, this effect has not been able to be avoided at the peripheral edge portion E of the input screen 26 on which the X-rays imping so as to cross the columnar crystals 32.

Figure 9:
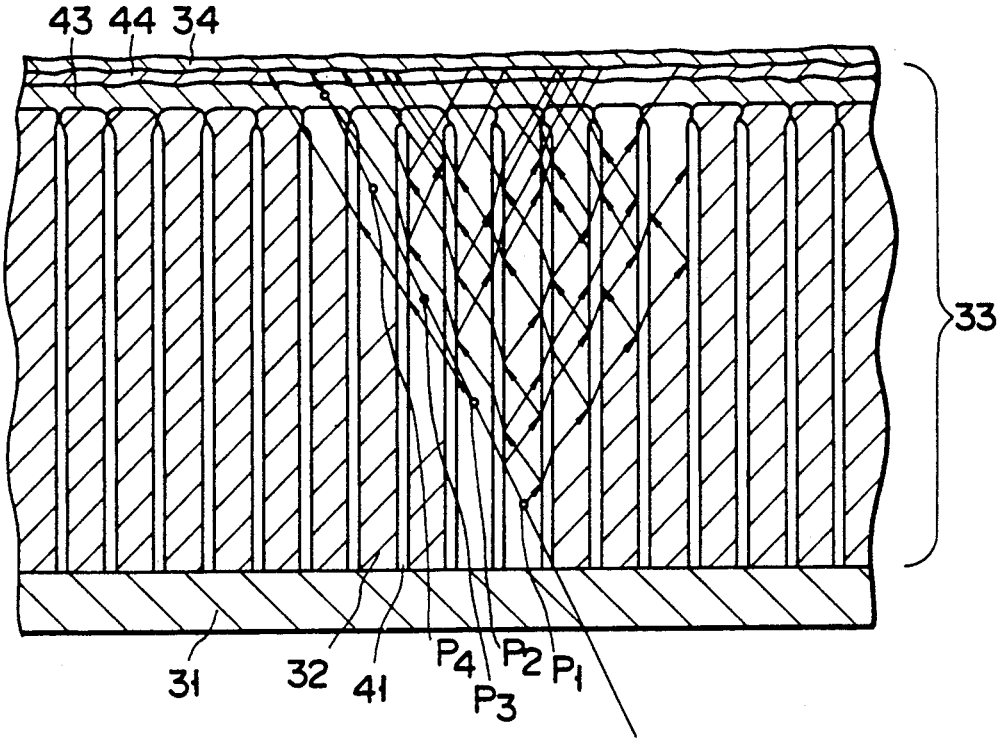
Figure 10:
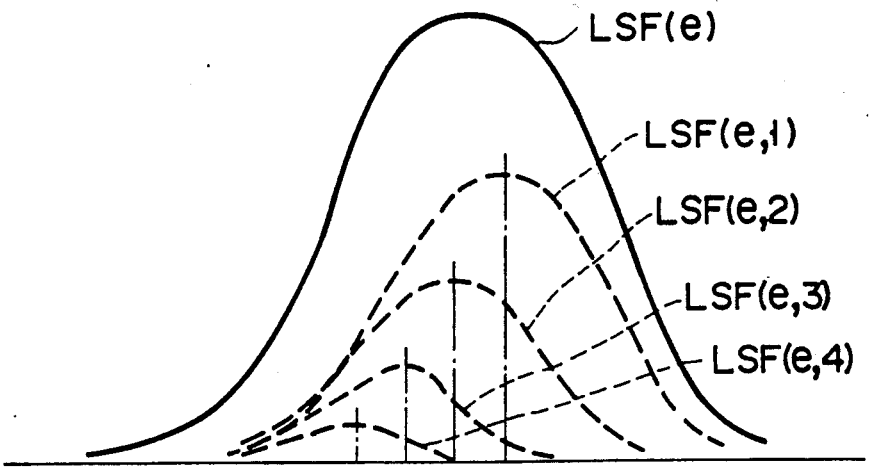

In the present embodiment, however, the reduction of the resolution is eliminated by making the columnar crystals 32 at the peripheral edge portion E of the input screen 26 thinner. Referring now to FIGS. 9 and 10, the way of propagation and line spread functions of the incident X-rays at the peripheral edge portion E will be described.

As shown in FIG. 9, some of the X-rays incident upon the peripheral edge portion E of the input screen 26 at a tilted angle thereto are absorbed at a shallow position P1 with respect to the incidence side, thus producing fluorescence. The fluorescence produced at the position P1 spreads sideways, while repeating reflection and attenuation during transmission many times, as it passes through adjacent columnar crystals 32, and then reaches the photoemissive layer 34. Since the crystals 32 are thinner, however, the frequency of reflection per unit distance is higher than in the case of the central portion C of the input screen 26 shown in FIG. 7.

Thus, the range of the equivalent transverse propagation of the incident X-rays is narrower, so that line spread function LSF(e,1) of the fluorescence produced at the position P1 at the peripheral edge portion E of the input screen 26, as shown in FIG. 8, is narrower than LSF(c,1) for the case of the central portion C shown in FIG. 8.

Since the X-rays are diagonally incident upon the peripheral edge portion E of the input screen 26, the remaining X-rays reach a position P2 to produce fluorescence after being partially attenuated. The line spread function of the fluorescence produced at the position P2 is LSF(e,2), as shown in FIG. 10. Repeating the operation in like manner, thereafter, line spread functions LSF(e,3) and LSF(e,4) are obtained for fluorescences produced at positions P3 and P4, respectively, and synthetic line spread function LSF(e) can be obtained by synthesizing these individual functions.

Thus, at the peripheral edge portion E of the input screen 26, the columnar crystals 32 are thinner, and line spread functions LSF of the fluorescences produced at the positions P1, P2, P3 and P4 are narrower. Accordingly, these line spread functions LSF are deviated from the incidence position in the direction of width. However, the width of the synthetic line spread function LSF(e) at the peripheral edge portion E of the input screen 26 is equal to or shorter than the width of the synthetic line spread function LSF(c) at the central portion C.

Thus, according to the present embodiment, although the X-rays are diagonally incident upon the peripheral edge portion E of the input screen 26, the resolution cannot be lowered, and there is no difference in resolution between the central portion and the peripheral edge portion of the X-ray image intensifier.

Average outside diameter W2(e) of the columnar crystals 32 at the peripheral edge portion E can be made shorter than average outside diameter W2(c) of the crystals 32 at the central portion C by varying the temperature of the substrate 31 between the portions C and E in forming the columnar crystals 32 of, e.g., CsI:Na phosphor on the substrate by vacuum evaporation.

If the columnar crystals 32 are used directly in the phosphor layer 33 so that their thickness at the the central portion of the input screen 26 differs from the thickness at the peripheral edge portion, fine pinholes develop at shorter intervals in the peripheral edge portion of their surface than in the central portion. Accordingly, the alkaline metals which constitute the photoemissive layer 34 on the phosphor layer 33 inevitably diffuse into the phosphor layer, so that the sensitivity of the photoemissive layer lowers. As a result, the brightness of the peripheral edge portion E of the input screen 26 becomes lower than that of the central portion C, that is, the so-called shading is enhanced.

According to the present embodiment, as described above, there may be provided an X-ray image intensifier in which the resolution and brightness at the peripheral edge portion E of the input screen 26 lower less, so that the central portion and the peripheral edge portion of the input screen can enjoy uniform resolution and brightness.

Additional advantages and modifications will readily occur to those skilled in the art. Therefore, the invention in its broader aspects is not limited to the specific details, representative devices, and illustrated examples shown and described herein. Accordingly, various modifications may by without departing from the spirit or scope of the general inventive concept as defined by the appended claims and their equivalents.

What is claimed is:

1. An X-ray image intensifier comprising:

an input screen for converting incident X-rays into photoelectrons; and an output screen opposed to the input screen and adapted to convert the photoelectrons from the input screen into visible radiation;

said input screen including a substrate, a phosphor layer having a large number of columnar crystals of a phosphor formed with gaps therebetween on the substrate, and a photoemissive layer directly or indirectly provided on the phosphor layer; and the cross section of said columnar crystals at a peripheral edge portion of the input screen being smaller than that of the columnar crystals at a central portion of the input screen.

2. An X-ray image intensifier according to claim 1, wherein each of said columnar crystals has a distal end portion kept apart from the substrate, the respective distal end portions of said columnar crystals being arranged with gaps narrower than the gaps between the other portions of the crystals.

3. An X-ray image intensifier according to claim 2; wherein each of said distal end portions of said columnar crystals has a cross section greater than that of the other portion of the crystal. and the respective distal end portions of the columnar crystals are in intimate contact with one another.

4. An X-ray image intensifier according to claim 3, wherein said distal end portions of said columnar crystals are formed flat to constitute a continuous surface in conjunction with one another.

5. An X-ray image intensifier according to claim 4, wherein said phosphor layer includes an outer layer of a phosphor, formed on the continuous surface formed of the distal end portions, and a conductive protective layer formed on the outer layer, said photoemissive layer being formed on the protective layer.

6. An X-ray image intensifier according to claim 3, wherein the ratio of the diameter of said distal end portion of each said columnar crystal to that of the other portion is higher at the peripheral edge portion of the input screen than at the central portion thereof.

7. An X-ray image intensifier according to claim 1, wherein the distance from the boundary between the distal end portion and the other portion of each of said columnar crystals to the photoemissive layer is set to approximately 10 $\mu$m or less.

8. An X-ray image intensifier according to claim 1, wherein said substrate has a concave inner surface facing the output screen, and said columnar crystals are formed on the inner surface of the substrate so as to extend toward the center of curvature of the substrate.

* * * * *